United States Patent [19]

Thomas

[11] Patent Number: 4,658,570

[45] Date of Patent: Apr. 21, 1987

[54] WOOD BUNDLING DEVICE

[76] Inventor: Harold D. Thomas, Rte. 9, Cumming, Ga. 30130

[21] Appl. No.: 588,091

[22] Filed: Mar. 9, 1984

[51] Int. Cl.[4] ..... B65B 11/02

[52] U.S. Cl. ..... 53/556; 53/588

[58] Field of Search ..... 53/399, 441, 291, 292, 53/556, 575, 585, 587, 588

[56] References Cited

U.S. PATENT DOCUMENTS

| | | | |
|---|---|---|---|
| 2,890,558 | 6/1959 | Eddison | 53/292 |
| 3,792,564 | 2/1974 | Brady | 53/585 X |
| 4,079,565 | 3/1978 | Lancaster | 53/556 X |
| 4,144,631 | 3/1979 | Fujio | 53/556 X |
| 4,166,348 | 9/1979 | Carlson | 53/588 X |
| 4,208,857 | 6/1980 | Fujio | 53/585 |
| 4,241,564 | 12/1980 | Quarenghi | 53/575 |
| 4,302,920 | 12/1981 | Lancaster | 53/556 X |
| 4,317,322 | 3/1982 | Lancaster | 53/588 X |
| 4,355,496 | 10/1982 | Teates | 53/587 |

*Primary Examiner*—John Sipos

*Attorney, Agent, or Firm*—B. J. Powell

[57] ABSTRACT

A bundling device for bundling elongate articles such as firewood with plastic film including a wood support for fixedly supporting the articles to be bundled, a film support to support a roll of the plastic film to be wrapped around the articles and a drive for rotating the film support around the articles on the wood support to wrap the film around the wood carried on the wood support. The film support includes a brake to maintain tension in the film as it is being wrapped around the articles and which increases the tension in the film when it is desired to break the film after the articles have been wrapped.

7 Claims, 12 Drawing Figures

WOOD BUNDLING DEVICE

BACKGROUND OF THE INVENTION

This invention relates generally to bundling devices and more particularly to a bundling device for wrapping plastic film around a group of elongate articles to form a bundle thereof.

Various techniques have been employed to bundle elongate articles such as firewood. By and large, the bundling operation is performed by applying one or more bands around the bundle of firewood to hold the bundle together. This technique typically requires extensive manual labor to hold the firewood and apply the bands therearound. Also, the use of the bands leaves the firewood in the bundle exposed so that the person carrying the bundle is subject to soiling his clothes and/or being stuck with wood splinters from the bundle.

More recently, plastic film has been wrapped around the bundle after the bands have been applied thereto to protect the person carrying the bundle and to prevent debris from falling out of the bundle as it is transported. Since the plastic film was applied after the bundle was banded, the bundling cost was high.

SUMMARY OF THE INVENTION

These and other problems and disadvantages associated with the prior art are overcome by the invention disclosed herein by providing a bundling device for bundling the elongate articles such as firewood which wraps a plastic film around the firewood to form a bundle without requiring that the firewood first be banded in the bundles before the plastic film is applied. Further, the wrapping of the plastic film around the bundle is substantially automated to minimize the amount of labor required in the bundling operation. Further, means is provided for automatically unloading the bundle from the device without affecting bundle integrity. Means is provided for automatically maintaining a prescribed tension in the film as it is wrapped around the aritcles and the film is automatically broken after a prescribed number of wraps have been made around the articles to assure bundle integrity and minimize the amount of plastic film being used.

The apparatus of the invention includes generally a wood support into which the elongate articles can be laid for bundling and a film support adapted to support a roll of plastic film so that the roll of film can be moved concentrically around the wood support with a drive means for rotating the film support around the wood support. After the end of the film is applied to the articles in the wood support, the drive means is activated to rotate the film support around the wood support to wrap the film. The roll of film is also rotatably mounted on the film support so that the sheet of film can be unrolled from the roll of film as the film support is rotated around the wood support. A tension control device is provided for selectively maintaining a prescribed tension in the film as it is being unwound from the roll of film to assure bundle integrity. The tension device is further controlled so as to increase the tension in the film being wound around the articles sufficiently to break it after the desired number of layers of film have been wrapped around the articles. The rotation of the film support means around the wood support means is then stopped and an unloading means is activated to push the completed bundle of articles off of the wood support means without affecting the integrity of the bundle.

These and other features and advantages of the invention described herein will become more apparent upon consideration of the following specification and accompanying drawings wherein like characters of reference designate corresponding parts throughout the several views and in which:

Figure 1:
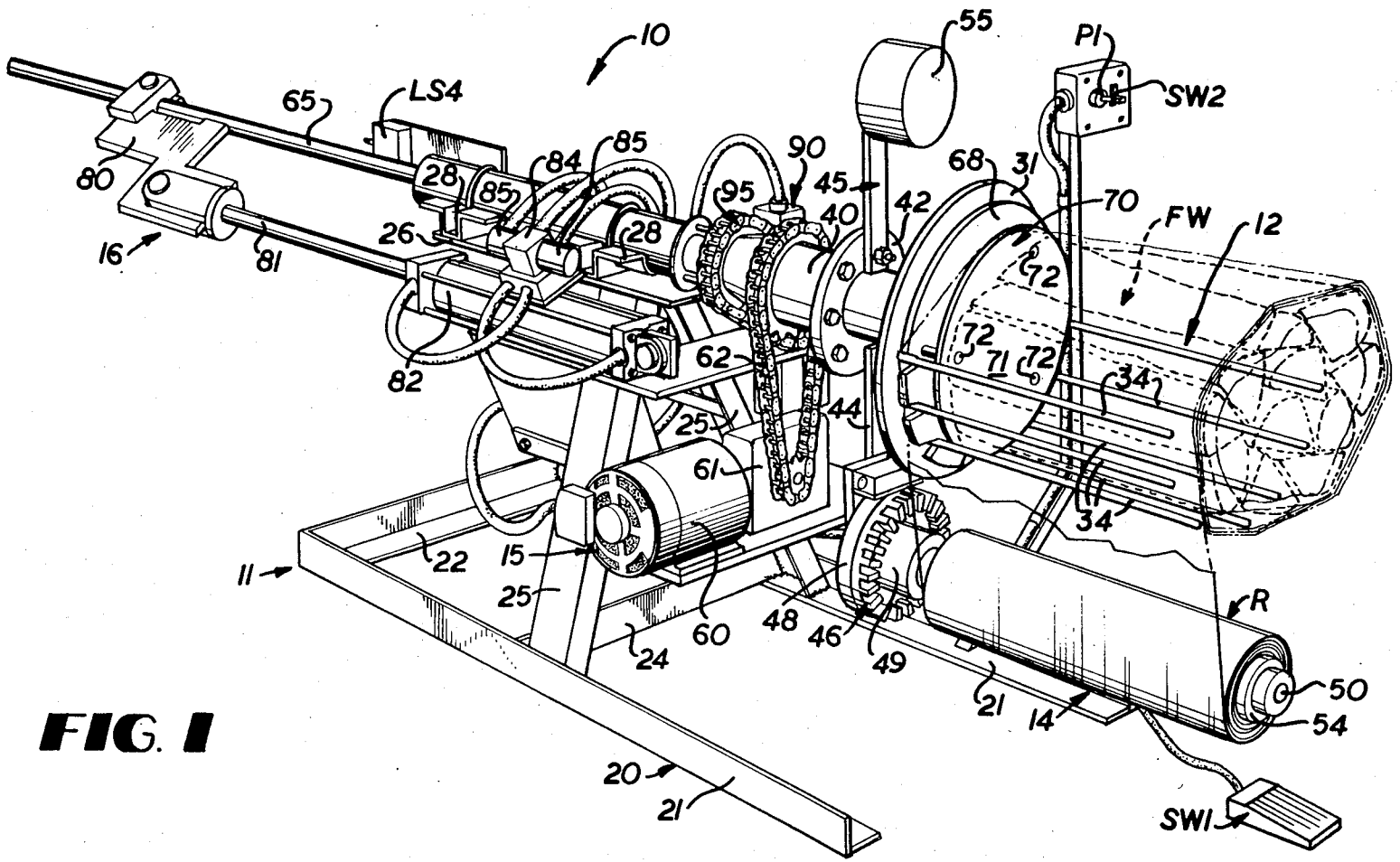
FIG. 1 is a perspective view illustrating the invention.

These figures and the following detailed description disclose specific embodiments of the invention; however, it is to be understood that the inventive concept is not limited thereto since it may be embodied in other forms.

DETAILED DESCRIPTION OF ILLUSTRATIVE EMBODIMENTS

Referring to the figures, it will be seen that the bundling device 10 incorporating the invention includes a base frame 11 which mounts a wood support assembly 12 thereon to support the elongate articles illustrated as firewood FW in the drawings for bundling. A film support assembly 14 is rotatably mounted on the wood support assembly 12 to mount the roll R of plastic film thereon for movement of the roll R concentrically around the firewood FW carried in the wood support assembly 12. A drive unit 15 is mounted on the base frame 11 for selectively rotating the film support assembly 14 around the wood support assembly 12. An unloading mechanism 16 is mounted on the wood support assembly 12 to selectively unload the firewood FW from the wood support assembly 12 after it has been wrapped with the film to form the bundle B.

Figure 2:
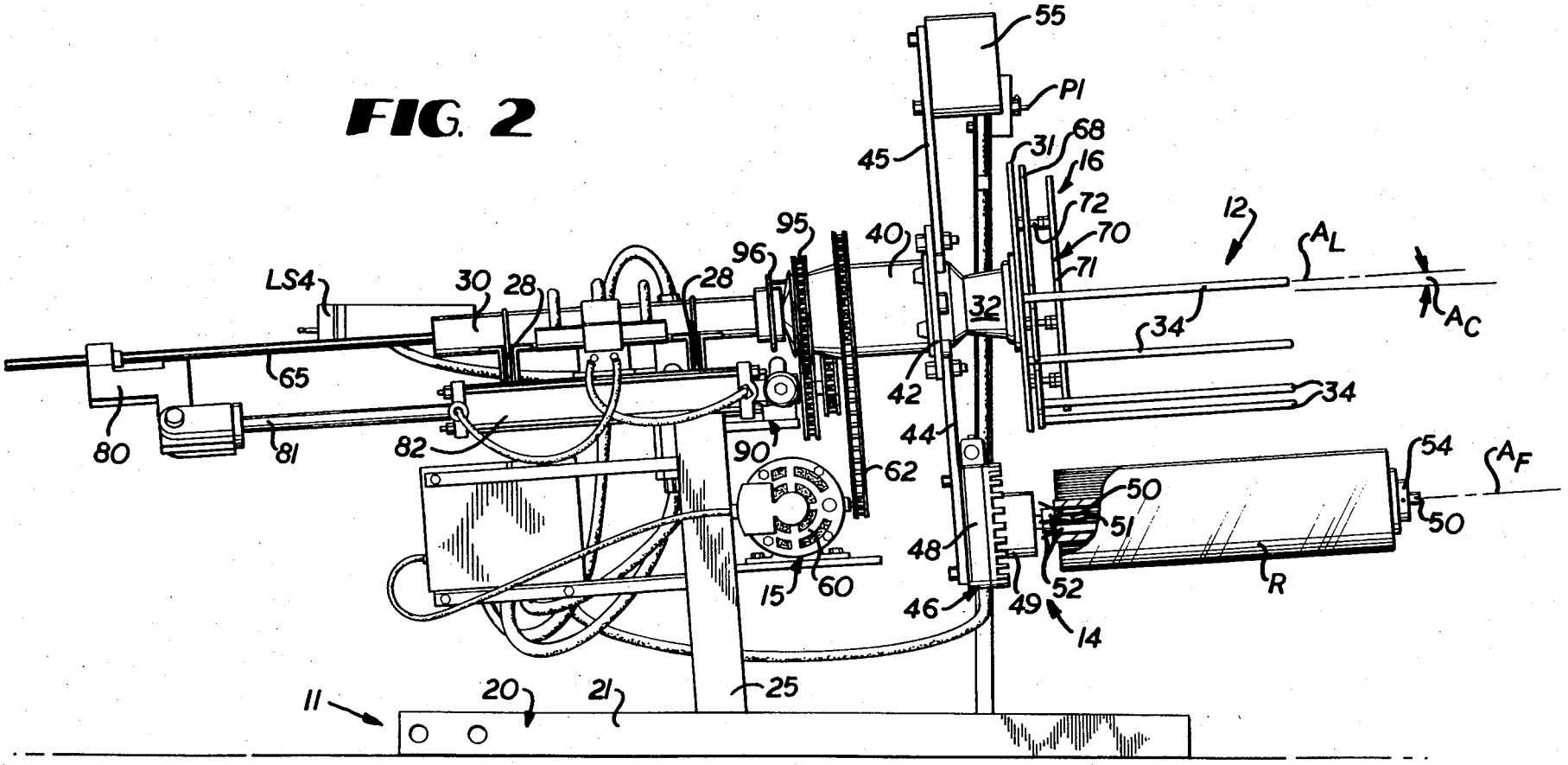
FIG. 2 is a side elevational view of the invention.

The base frame 11 includes generally a U-shaped base 20 with spaced apart side members 21 joined at one end by an end member 22 so that the side members 21 are maintained in a spaced apart generally paralled position. A cross brace 24 joins the side members 21 intermediate their ends. A pair of upstanding support legs 25 are joined at their lower ends to side members 21 adjacent the cross brace 24 and angle upwardly and inwardly therefrom to be joined at their upper ends in an inverted V-shape. A mounting plate 26 is attached to the upper end of the support legs 25 and is oriented so that it is located above and centered between the side members 21. A pair of tube mounts 28 are mounted on the top of the mounting plate 26 and serve to mount the wood support assembly 12 thereon so that the longitudinal axis $A_L$ of the wood support assembly 12 is oriented generally parallel to the side members 21 when viewed from the top of the machine but is angled as the angle $A_C$ with respect to the horizontal when viewed from the side as seen in FIG. 2. As will become more apparent, this serves to keep the firewood FW in the wood support assembly 12 as it is being wrapped.

The wood support assembly 12 includes an elongate support tube 30 mounted in the tube supports 28 so that the tube 30 extends along the axis $A_L$. The support tube 30 projects forwardly of the mounting plate 26 (to the rights as seen in FIG. 2) to provide clearance for the film support assembly 14 as will become more apparent. The support tube 30 mounts circular support plate 31 with its support hub 32 on the forwardly projecting end thereof so that the support plate 31 is held fixed with respect to the support tube 30. Mounted on the support plate 31 and projecting forwardly thereof are a plurality of wood support rods 34. The wood support rods 34 are arranged at circumferentially spaced positions on the support plate 31 along a semicircular path so that the support rods 34 project forwardly of the lower half of the support plate along paths which are generally paralled to the axis $A_L$ while the support plate 31 is oriented generally perpendicular to the axis $A_L$ to define an open top wood receiving space thereabove. As will become more apparent, it will be seen that the pieces of firewood will be stacked on the support rods 34 until the desired number of pieces are resting thereon for the bundling operation. The spacing between the support rods 34 is selected so that the pieces of firewood will not fall therebetween.

The film support assembly 14 includes a base hub 40 which is rotatably mounted on the support tube 30 of the wood support assembly 12 forwardly of the mounting plate 26 on the base frame 11 and rearwardly of the support hub 32 on the support assembly 12. The base hub 40 is rotatably mounted on the support tube 30 with bearings 41 so that the base hub 40 is free to rotate about the axis $A_L$. The base hub 40 defines a mounting flange 42 on the forward end thereof on which is mounted a film support arm 44 and a counterweight arm 45 which extend diametrically outward from opposite sides thereof so that the arms 44 and 45 are generally perpendicular to the axis $A_L$.

Mounted on the outer extending end of the arm 44 is an electromagnetic brake 46. The housing 48 of the brake 46 is connected to the arm 44 while the other operating member 49 of the brake 46 mounts a film support shaft 50 therein so that the film support shaft 50 projects forwardly of the brake 46 along the path generally parallel to the axis $A_L$ of the wood support assembly 12. It will further be appreciated that the length of the film support arm 44 is such that the film support shaft 50 is spaced outboard of the wood support rods 34 sufficiently for the roll R film to clear same during the wrapping operation as will become more apparent. The film support shaft 50 is fixedly mounted in the operating member 49 as will become more apparent shaft 50 can rotate with the operating member 49 about axis $A_F$.

Mounted on the film support shaft 50 adjacent member 49 is a core locking member 51 as seen in FIG. 2 which is rotationally fixed relative to the shaft 50. The core locking member 51 is provided with detents 52 which serve to frictionally engage the fiber board core in the roll R of the film. Also provided is a holding member 54 adapted to be fixedly yet releasably attached to the shaft 50 in opposition to the core locking member 51 to hold the core of roll R in sufficient contact with the detents 52 to keep the roll R from rotating with respect to the film support shaft 50. Thus, it will be seen that rotation of the roll R about axis $A_F$ serves to rotate the operating member 49 with respect to the housing 48 of the clutch 46.

As will become more apparent, the brake 46 is constructed so that the amount of force required to rotate the operating member 49 with respect to the housing 48 can be varied by varying the voltage applied to the brake 46. It will further be appreciated that, when the full operating voltage is applied to the brake 46, the operating member 49 will be locked with respect to the housing 48.

The counterweight arm 54 mounts a counterweight 55 on the projecting end thereof. The counterweight 55 is sized to lie rearwardly of the circular support plate 31 on the wood support assembly 12 so as to not interfere with the film being wrapped around the firewood FW as will become more apparent. The counterweight 55 is also sized to counterbalance the weight of the roll R of film in the brake 46 to maintain balance while the film support assembly is rotating about axis $A_L$.

The drive unit 15 includes an electrical drive motor 60 driving a gear reducer 61. The output of the gear reducer 61 is connected to the base hub 40 of the film support means 14 through a chain and sprocket arrangement 62. Thus, when the drive motor is rotating, the hub 40 will be rotated. This in turn causes the roll of film mounted on the film support means 14 to be moved concentrically about the axis $A_L$ of the wood support assembly 12.

The unloading mechanism 16 includes a positioning rod 65 slidably mounted in the passage through the support tube 30 of the wood support assembly 12 on bearings 66 at opposite ends of the support tube 30. Mounted on the forwardly projecting end of the positioning rod 65 projecting forwardly of the circular support plate 31 is a circular base plate 68 which is oriented normal to the axis $A_L$ and has a radius greater than the radius of the semicircular path along which the wood support rods 34 are mounted in the support plate 31. The circular base plate 68 is appropriately notched at 69 to receive the support rods 34 therein so that, as the positioning rod 65 is reciprocated, the circular base plate 68 can be moved forwardly of the support plate 31 and retracted back toward the plate 31.

Mounted on the circular base plate 68 is a spacer plate assembly 70 which serves to locate the firewood FW longitudinally of the wood support rods 34 as will become more apparent. The spacer plate assembly 70 includes a circular plate 71 with a radius smaller than the radius of the semicircular path along which the support rods 34 are positioned and a plurality of mounting bolts 72 which connect the spacer plate 71 to the base plate 68. The base plate 68 defines circumferentially spaced apart holes therethrough which slidably mount the mounting bolts 72 therein. The heads 74 on the mounting bolts 72 are located rearwardly of the base plate 68 while the projecting ends of the mounting bolts 72 threadedly engage the circular spacer plate 71 forwardly of the plate 31. Lock nuts 75 maintain the bolts 72 threadedly engaged in the spacer plate 71. Also mounted on each mounting bolt 72 between the base plate 68 and the lock nut 75 is a stop nut 76. Since the bolts 72 are slidably mounted in the base plate 68, it will be appreciated that the spacer plate 71 can shift forwardly of the base plate 68 until the undersides of the heads 74 on the bolts 72 engage the base plate 68. Likewise, it will be seen that the spacer plate 71 can move toward the base plate 68 until the stop nuts 76 engage the base plate 68.

Figure 5:
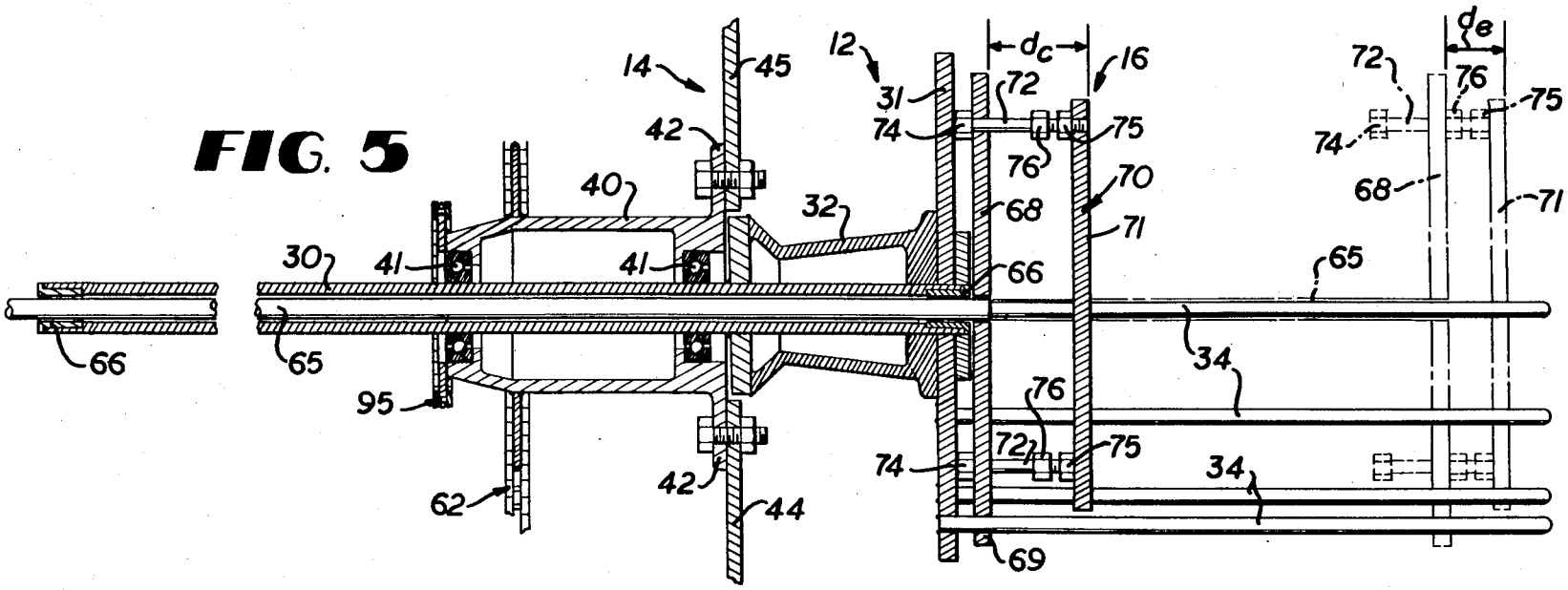
FIG. 5 is a longitudinal cross-sectional view of the invention.

As best seen in FIG. 5, the retraction of the base plate 68 toward the support plate 31 on the wood support assembly 12 causes the heads 74 on the mounting bolts 72 to engage the front face of the support plate 31 when the base plate 68 reaches the vicinity of the support plate 31. As the base plate 68 continues to be retracted toward the support plate 31, the support plate 31 arrests the movement of the mounting bolts 72 with respect to the support plate 31 to stop the retraction of the circular spacer palte 71. The circular base plate 68, however, can continue to retract toward the support plate 31 until the base plate 68 engages the undersides of the heads 74 on the mounting bolts 72. In this position, it will be seen that the support plate 31 and base plate 68 clamp the heads of the bolts 72 therebetween to hold the spacer plate 71 in an extended position spaced forwardly of the base plate 68 by a clearance distance $d_c$ seen in FIG. 5. As the base plate 68 is extended forwardly of the support plate 31, however, the base plate 68 can slide along the mounting bolts 72 while the spacer plate 71 remains stationary until the base plate 68 engages the stop nut 76 to start moving the spacer plate 71 with the base plate 68. Thus, the spacing between the spaccer plate 71 and base plate 68 is reduced to the ejection distance $d_e$ as shown by phantom lines in FIG. 5. As will become more apparent, this permits the plastic film wrapped around the firewood FW and the wood support rods 34 to be stripped therefrom as the bundle is removed without damaging the plastic film in the process.

The rearwardly projecting end of the positioning rod 65 is provided with a connector 80. The connector 80 is in turn connected to the piston rod 81 of a fluid cylinder 82 which is connected to the base frame 11. It will thus be seen that as the piston rod 81 is retracted, the base plate 68 along with the spacer plate 71 will be extended forwardly of the support plate 31 and vice versa. As will become more apparent, the fluid cylinder 82 is retracted to eject the completed bundle B from the wood support assembly 12 and then reextended so that another batch of firewood FW can be placed in the wood support assembly 12 for bundling.

The operation of the fluid cylinder 82 is controlled with the electrical solenoid valve 84. This valve is constructed so that when one of the solenoids 85 thereon is momentarily energized, the valve remains in that control position until the other solenoid 85 is momentarily energized.

Figure 4:
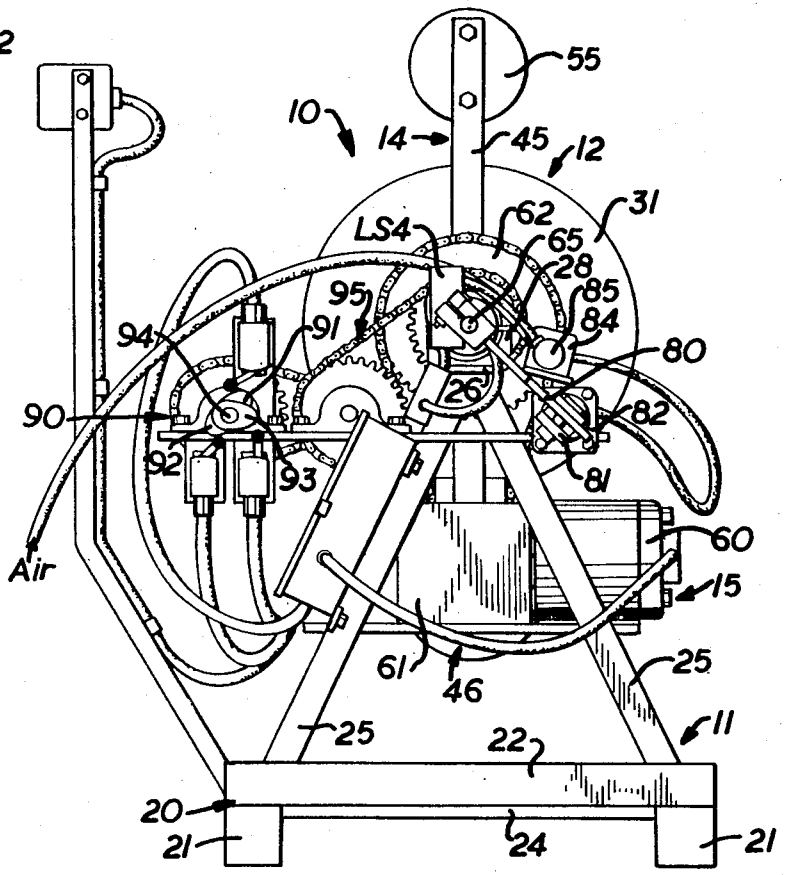
FIG. 4 is a rear elevational view of the invention.
Figure 3:
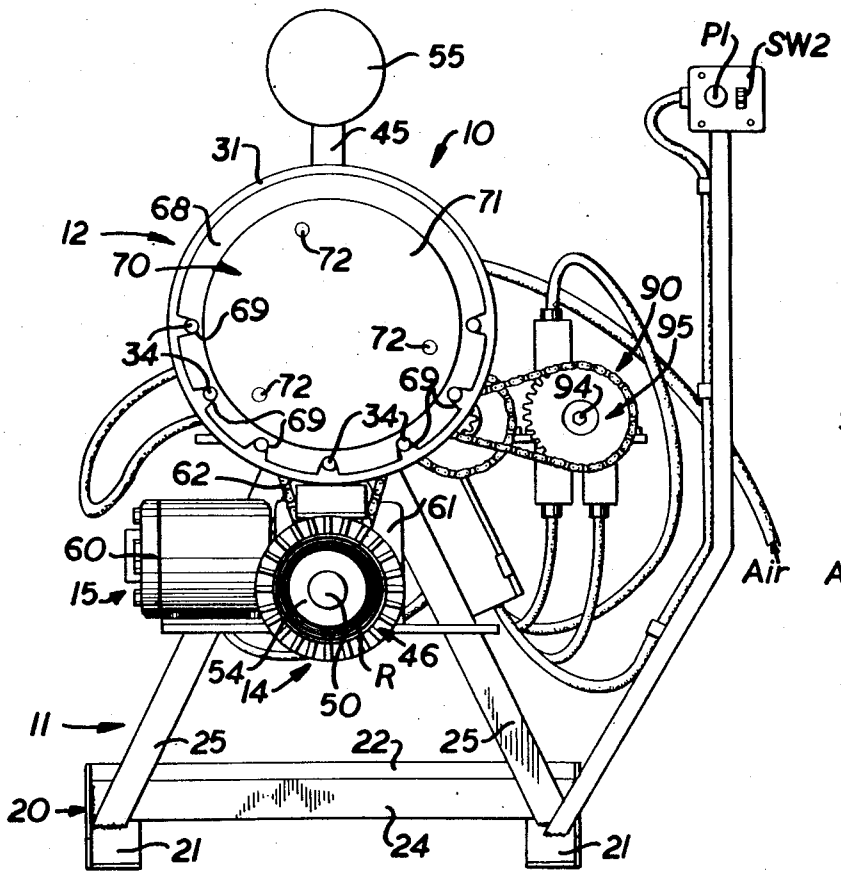
FIG. 3 is a front elevational view of the invention.

To control the overall operation of the bundling device 10, a cam switch assembly 90 best seen in FIGS. 3 and 4 is provided. The assembly 90 includes three cams 91–93 mounted on shaft 94. The shaft 94 is rotatably journalled on the support frame 11 and is drivingly connected to the hub 40 of the film support assembly 14 by a chain and sprocket arrangement 95. While the ratio can be selectively changed, the particular chain and sprocket arrangement 95 causes the cam shaft 94 to be rotated about one revolution for every five revolutions of the hub 40.

A normally closed limit switch LS1 is operatively associated with cam 91, normally open limit switch LS2 is operatively associated with cam 92 and normally open limit switch LS3 is operatively associated with cam 93. As will become more apparent, switch LS1 controls the operation of motor 60, LS2 controls the brake 46 and switch LS3 controls the solenoid valve 84.

Figure 6:
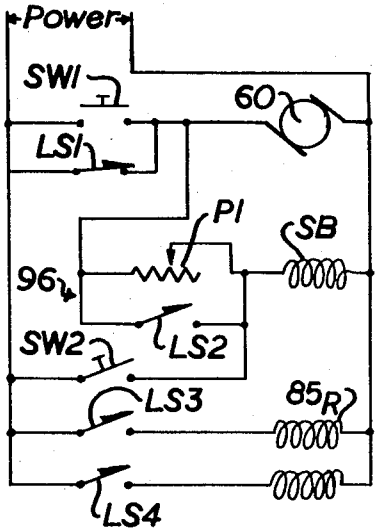
FIG. 6 is an electrical schematic for the invention.

As seen schematically in FIG. 6, power is supplied to motor 60 by switch LS1 and momentary start switch SW1 (FIG. 1) in parallel with each other. While switch LS1 is normally closed, the cam 91 operating same is oriented so that it opens switch LS1 at the end of a wrapping cycle. Since switch SW1 is normally open, this stops motor 60 from operating. To start a cycle, start switch SW1 is manually closed to start motor 60. As soon as the cam 91 moves off of switch LS1, it keeps the motor 60 operating until cam 91 has rotated a complete revolution to again open switch LS1 and stop the motor. In the particular version illustrated, the motor 60 is stopped after the roll R of film has been moved around the wood support assembly 12 five times.

As also seen schematically in FIG. 6, power is supplied to the brake control circuit branch 96 as long as motor 60 is powered. The solenoid $S_B$ in brake 46 is normally powered through potentiometer P1 (FIG. 1) which can be manually adjusted to vary the voltage supplied to solenoid $S_B$. As will become more apparent, the voltage is adjusted so that the desired tension is maintained in the film as it is wrapped around the firewood FW. The limit switch LS2 is connected in paralled across the potentiometer P1 so that when switch LS2 is closed, full voltage is applied to solenoid $S_B$ in brake 46 to fix the member 49 with respect to housing 48. The cam 92 is set to close switch LS2 during the final revolution of the film roll R around the wood support assembly 12 in the wrapping cycle (i.e. the fifth revolution). As will become more apparent, the cam 92 is constructed to keep switch LS2 closed long enough for the film to break but is opened by the time the motor 60 is stopped at the end of the cycle. A rotary contact assembly 96 seen in FIG. 2 supplies the power to brake 46 across the fixed/movable interface between tube 30 and hub 40.

A by-pass switch SW2 may be provided so that the solenoid $S_B$ can be manually energized. This facilitates the mounting of the film roll R between the core locking member 51 and holding member 54.

The valve 84 has the retraction solenoid $85_r$ thereon powered through the limit switch LS3. The cam 93 is designed to momentarily close switch LS3 just before the wrap cycle is completed and after the film wrapping the firewood has been broken. This shifts valve 84 to its retract position to supply fluid to the rod end of cylinder 82 and retracts the piston rod 81. A normally open limit switch LS4 is mounted on the support frame 11 so that the connector 80 engages its actuator when piston rod 81 has been retracted. Switch LS4 is used to power the extend solenoid $85_E$ on valve 84 so that when connector 80 momentarily closes switch LS4, the valve 84 is shifted to supply fluid to the closed end of cylinder 82 and extend piston rod 81 back to the position seen in FIG. 1.

Figure 7:
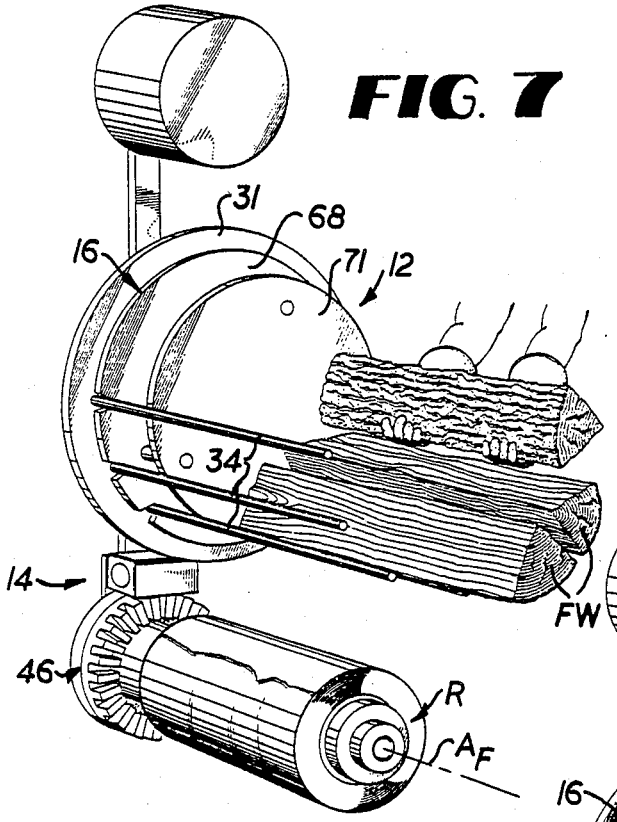
FIGS. 7–11 schematically illustrate the operation of the invention.

In operation, the operator first lays the desired number of pieces of firewood FW onto the wood support rods 34 in the wood support assembly 12 as illustrated in FIG. 7. It will be noted that the ends of the firewood FW abut the spacer plate 71. The angle $A_c$ at which the support assembly 12 is tilted with respect to the horizontal causes the support rods 34 to angle upwardly toward their projecting ends. The distance the rods 34 project forwardly of the plate 71 in its retracted position is at least greater than about half the length of the firewood FW. These features cause the firewood FW to stay on the rods 34 as it is being wrapped. As will become more apparent, the length of the rods 34 is also less than the length of the firewood.

The plastic film used to wrap the firewood FW is stretchable and has the ability to cling to itself, especially in the stretched condition. While a number of different films may be used, polyethylene film has been found satisfactory and is commercailly available under the tradename "Saran Wrap" from Dow Chemical Company. A continuous film sheet FS is wrapped onto the roll core to form the roll R. The width of the film sheet FS is selected to be greater than the length of the firewood FW. The roll R is positioned on the film support shaft 50 so that it is centered longitudinally of the firewood FW so that opposite edges of the film sheet FS will overlap opposite ends of the pieces of firewood FW as it is wrapped therearound as will become more apparent.

Figure 8:
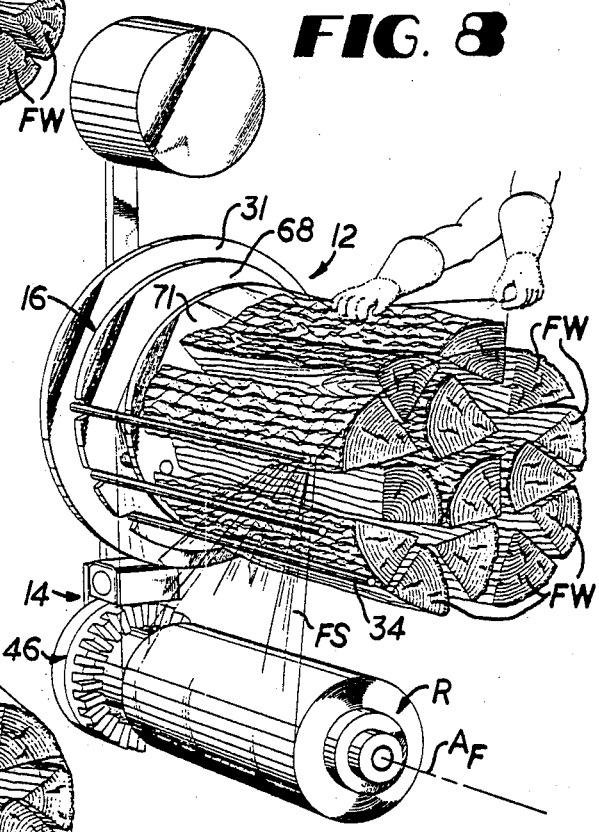

After the desired number of pieces of firewood FW have been placed on rods 34, the workman unrolls the film sheet FS until he can lap the end of sheet FS over the firewood enough to hold the sheet FS as seen in FIG. 8. Since the pieces of firewood FW are rough, the amount of overlap to start the wrapping operation is relatively small. As will become more apparent, the firewood FW on rods 34 is stacked until the stack generally matches the diameter of the spacer palte 71. The workman also locates the film sheet F5 longitudinally of the firewood FW so that the edge of the sheet FS overlaps the spacer plate 71 and lies between the plate 71 and the base plate 68. Since the brake 46 is not energized during this operation the roll R is free to rotate about its axis $A_F$ to facilitate the initial placement of the end of the film sheet FS on the firewood FW. It will likewise be appreciated that the initial placement of the end of the film sheet FS around the firewood FW is opposite in the sense of the movement of the roll R around the assembly 12.

Figure 9:
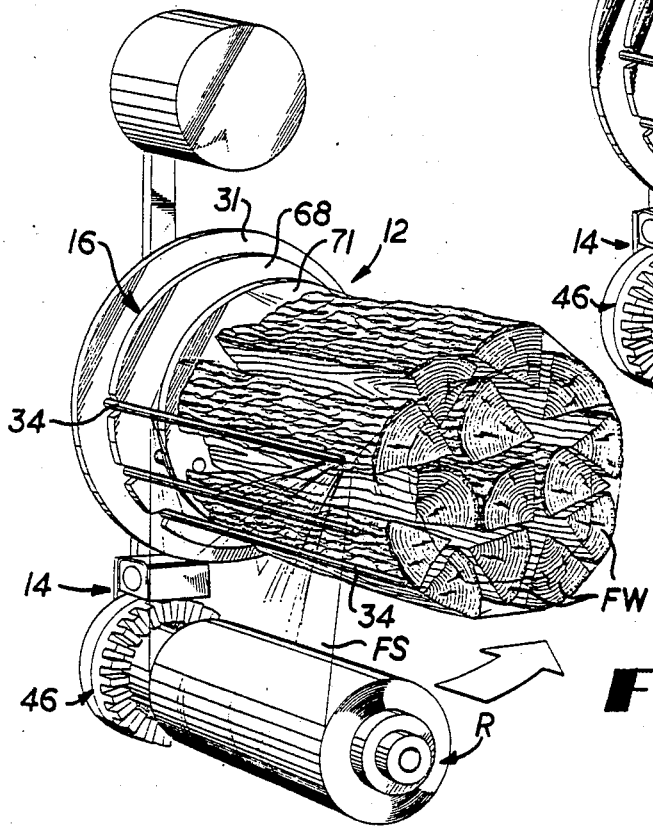

The workman than closes switch SW1 to start motor 60 and energize brake 48 through the potentiometer P1. This causes the roll R to be moved circumferentially around the wood support assembly 12 about axis $A_L$ as seen in FIG. 9. Since the end of the film sheet F5 is held on the firewood FW, this motion causes the film sheet FS to be wrapped aound the firewood FW and over the wood support rods 34. To do this, the film sheet is unrolled from the roll R against the retraining force of the brake 48. The potentiometer P1 is adjusted so that the desired amount of tension is maintained in the film sheet FS to stretch it tautly around the firewood FW and cause the edges of the sheet FS to pull in over the ends of the pieces of firewood and over the spacer plate 71.

Figure 10:
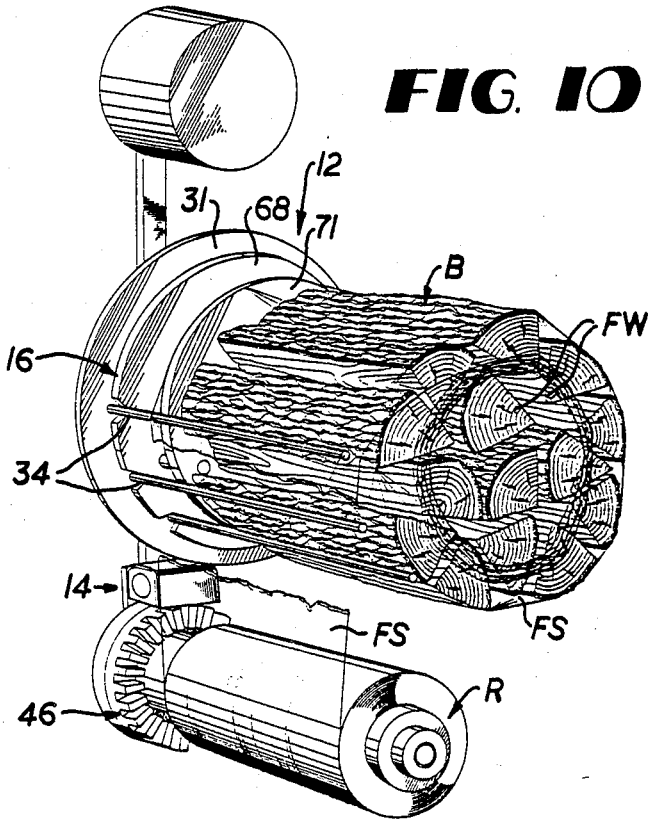

During the final revolution in the wrapping cycle, the cam 92 closes the limit switch LS2 to short out the potentiometer P1 and apply the full voltage to brake 48. This prevents further rotation of the roll R about its axis $A_F$ while the motor 60 continues to rotate the roll R around the axis $A_L$. As a result, the film sheet FS is stretched beyond its breaking point as seen in FIG. 10 to sever the sheet FS. This causes the broken end of the film sheet FS wrapped around the firewood FW and the rods 34 to adhere to the layer of the sheet lying under this broken end. The film now holds the firewood FW into a bundle B but still is wrapped around the support rods 34.

Figure 11:
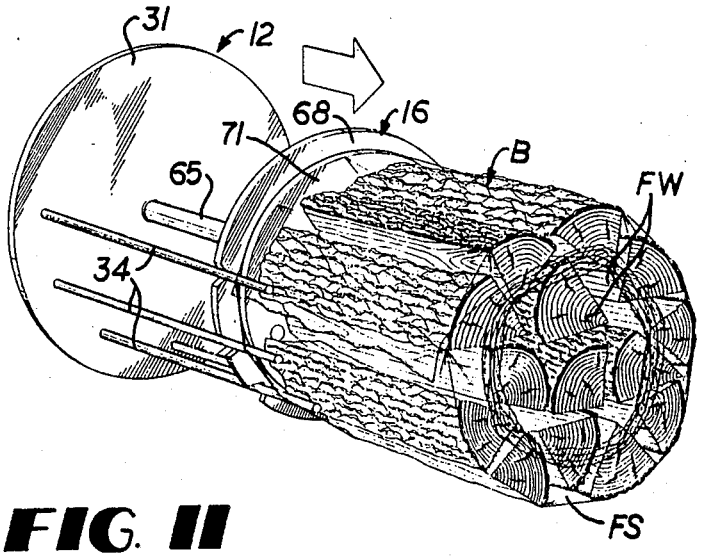

Just before the cam 91 opens limit switch LS1 to stop motor 60, the cam 93 momentarily closes limit switch LS3 to start the unloading operation. This transfers valve 84 to start the piston rod 81 retracting. This serves to start moving the base plate 68 forwardly away from the support plate 31 toward the rear end of the firewood FW. As hereinbefore described, the spacer plate 71 is not yet moved. As the base plate 68 moves, those portions of the base plate 68 projecting between the support rods 34 engage the edges of the film sheet FS and start pushing these edges along rods 34. Before the edges of the film sheet FS are caught between plates 68 and 71, the stop nuts 76 are engaged by the base plate 68 to start the movement of the spacer plate 71 therewith. Plate 71 thus starts pushing the firewood FW off of the rods 34 while the base plate 68 continues to push the trailing edges of the film sheet as best seen in FIG. 11. This motion continues until the bundle B drops off the ends of the rods 34.

By engaging the trailing edges of the film sheets FS with the base plate 68 prior to moving the firewood FW, the tension in the film sheet axially of the bundle B is relieved to prevent tearing the film as the firewood is stripped off rods 34. At the same time, pushing the firewood FW off of the rods 34 with plate 71 directly engaging the ends of the firewood prevents any damage to the trailing edges of the film since the film is not pressed against the trailing ends of the firewood. When the bundle B drops off the ends of the support rods 34, the trailing edges of the film sheet FS are pulled over the smooth outer periphery of the spacer plate 71 without damage thereto.

When the piston rod 81 reaches the end of its stroke, the limit switch LS4 is momentarily closed to reverse valve 84 and extend piston rod 81. This retracts the base plate 68 and spacer plate 71 back to the initial position so that the operation can be repeated.

Figure 12:
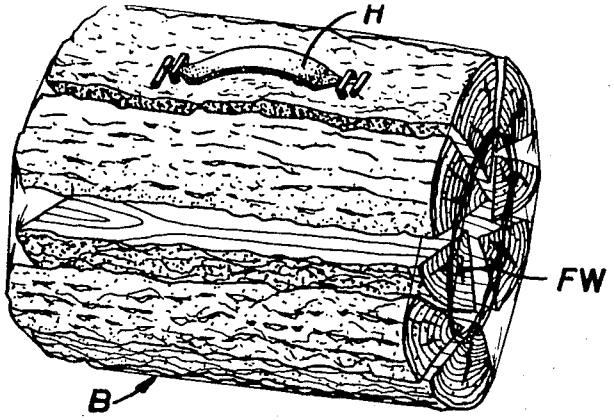
FIG. 12 is a perspective view illustrating the completed bundle made on the invention.

The handle H is then applied to the bundle B as seen in FIG. 12 to complete it. It will be seen that the bundle integrity is maintained solely by the film sheet FS without requiring any bonding.

What is claimed as invention is:

1. A bundling device for bundling elongate articles such as firewood with a plastic film comprising:

wood support means for supporting the articles to be bundled, said wood support means including an end support member; and a plurality of elongate wood support members mounted on said end support member at spaced apart positions and projecting perpendicularly outwardly therefrom in the same direction generally parallel to each other so as to define an open top article receiving space thereabove whereby the articles to be bundled can be stacked on said wood support members in said article receiving space;

film support means for supporting a roll of the plastic film to be wrapped around the articles to be bundled;

drive means for selectively moving said film support means around the articles to be bundled so that the film from the roll will be wrapped around the articles carried by said wood support means; and unloading means for selectively unloading the elongate articles from the support means after being wrapped with the film, said unloading means including a base plate reciprocally mounted over said wood support members for reciprocal movement toward and away from said end support member, reciprocating means for reciprocating said base plate longitudinally of said wood support members, a spacer plate adapted to be positioned over said wood support members and a plurality of mounting bolts mounting said spacer plate on said base plate, said base plate defining a plurality of holes therethrough through which said bolts slidably extend and said bolts having enlarged heads thereon located between said base plate and said end support member so that said bolt heads are captivated between said base plate and said end support member when said reciprocating means retracts said base plate toward said end support member to hold said spacer plate spaced from said base plate and so that said base plate can move a prescribed distance toward said spacer plate as said base plate moves away from said end support member, said base plate projecting between said wood support members to engage the film as said base plate moves away from said end support member before said spacer plate starts moving with said base plate to move the articles with the film.

2. The bundling device of claim 1 further including tensioning means for maintaining a prescribed tension in the film being wrapped around the articles.

3. The bundling device of claim 2 wherein said tensioning means is constructed and arranged to selectively maintain a first prescribed tension in the film being wrapped around the articles and to increase the tension after a prescribed number of layers of film have been wrapped therearound to cause the film to break.

4. The bundling device of claim 1 wherein said film support means includes a support arm assembly rotatably mounted about a longitudinal axis extending longitudinally through the articles stacked in said wood support means; a roll support for fixedly mounting the roll of film thereon; and means rotatably mounting said roll support on said support arm assembly so that the axis of the roll is spaced radially outwardly of and generally parallel to said longitudinal axis, and the roll is rotatable with respect to said support arm assembly about the roll axis.

5. The bundling device of claim 2 further including control means operatively connected to said drive means, said tensioning means and said unloading means to control the operation thereof; said control means constructed and arranged to cause said drive means to move said film support means around said wood support means and the articles for a prescribed number of times each time said control means is activated, to cause said tensioning means to maintain a first prescribed tension in the film as the fim is wrapped around the articles and to increase the tension in the film sufficiently to cause the film to break after a prescribed number of layers of film have been wrapped around the articles, and to cause said unloading means to push the articles and the film wrapped therearound off of said wood support means after said tensioning means has broken the film.

6. A bundling device for bundling firewood in plastic film wrapped around the firewood comprising:

a base frame;

a wood support assembly for supporting the firewood to be bundled, said wood support assembly including a support tube fixedly mounted on said base frame about a generally horizontal primary axis; a support plate fixedly mounted on one end of said support tube and oriented generally normal to said primary axis; and a plurality of wood support rods mounted in said support plate and extending outwardly therefrom opposite said support tube, said wood support rods arranged in spaced apart positions along an arcuate path below said primary axis and oriented generally parallel to said primary axis so that the firewood for bundling can be stacked on top of said wood support rods for the plastic film to be wrapped around the firewood and said wood support rods; and an unloading assembly for unloading the wrapped firewood from the wood support assembly, said unloading assembly comprising a positioning rod slidably extending through said support tube along the primary axis thereof and through said support plate; a base plate attached to said positioning rod over said wood support so that said base plate can be reciprocally moved axially of said wood support rods, said base plate projecting between said support rods to engage the plastic film wrapped around the firewood and said wood support rods as said base plate is moved away from said support plate and defining a plurality of mounting holes therethrough; a spacer plate adapted to fit against that end of the firewood facing said support plate under the plastic film wrapped therearound; a plurality of mounting bolts mounted on said spacer plate and slidably entending through said mounting holes in said base plate so that said spacer plate is located over said wood support rods on that side of said base plate opposite said support plate, said mounting bolts including bolt heads located between said base plate and said support plate so taht said bolt heads are captivated between said base plate and said support plate when said base plate is retracted to maintain said spacer plate spaced from said base plate yet allows said base plate to move toward said spacer plate for a prescribed distance as said base plate moves away from said support plate so hat said base plate moves the plastic film along said wood support rods before said spacer plate starts moving the firewood therealong; and means for reciprocating said positioning rod along the primary axis to cause said base and spacer plates to discharge the firewood and plastic film wrapping same off of said wood support rods.

7. The bundling device of claim 6 further including film wrapping means for wrapping the plastic film around the firewood, said film wrapping means comprising a hub member rotatably mounted on said support tube about the primary axis; a support arm attached to said hub and extending outwardly therefrom radially of the primary axis; an electromagnetic brake attached to the projecting end of said support arm; a roll support shaft mounted on said brake for rotation about a secondary axis oriented generally parallel to the primary axis and spaced outwardly thereof, said brake controlling the amount of force required to rotate said support shaft about the secondary axis; means mounting a roll of the plastic film on said roll support shaft so that the axis of the roll coincides with the secondary axis and the roll is rotationally fixed with respect to said roll support shaft; and means for rotating said hub about said primary axis so that the roll of plastic film is moved around the firewood and said wood support rods to wrap the film therearound while said brake controls the unwinding of the plastic film from the roll to maintain tension in the film.

* * * * *